US006189614B1

(12) United States Patent
Brady et al.

(10) Patent No.: US 6,189,614 B1
(45) Date of Patent: Feb. 20, 2001

(54) OIL AND GAS PRODUCTION WITH DOWNHOLE SEPARATION AND COMPRESSION OF GAS

(75) Inventors: Jerry L. Brady; Mark D. Stevenson; John M. Klein; James L. Cawvey, all of Anchorage, AK (US)

(73) Assignee: Atlantic Richfield Company, Los Angeles, CA (US)

( * ) Notice: Under 35 U.S.C. 154(b), the term of this patent shall be extended for 0 days.

(21) Appl. No.: 09/282,056

(22) Filed: Mar. 29, 1999

(51) Int. Cl.[7] ..... E21B 43/38; E21B 43/40

(52) U.S. Cl. ..... 166/266; 166/52; 166/265; 166/267; 166/370; 405/128

(58) Field of Search ..... 166/52, 105.5, 166/105.6, 265, 266, 267, 268, 370; 210/170, 747; 405/128

(56) References Cited

U.S. PATENT DOCUMENTS

| | | | | |
|---|---|---|---|---|
| 4,531,593 | | 7/1985 | Elliott et al. | 166/370 X |
| 5,044,440 | * | 9/1991 | Stinessen et al. | 166/105.6 |
| 5,207,810 | * | 5/1993 | Sheth | 166/105.6 X |
| 5,431,228 | | 7/1995 | Weingarten et al. | 166/357 |
| 5,450,901 | * | 9/1995 | Ellwood | 166/266 |
| 5,482,117 | | 1/1996 | Kolpak et al. | 166/265 |
| 5,605,193 | | 2/1997 | Bearden et al. | 166/370 |
| 5,662,167 | | 9/1997 | Patterson et al. | 166/265 |
| 5,794,697 | | 8/1998 | Wolflick et al. | 166/265 |
| 5,839,513 | * | 11/1998 | Czirr | 166/370 |
| 5,946,915 | * | 8/1999 | Hays | 210/747 X |
| 6,026,901 | * | 2/2000 | Brady et al. | 166/265 |
| 6,032,737 | * | 3/2000 | Brady et al. | 166/265 |
| 6,035,934 | * | 3/2000 | Stevenson et al. | 166/265 |
| 6,039,116 | * | 9/2000 | Stevenson et al. | 166/265 X |

* cited by examiner

*Primary Examiner*—George Suchfield

(57) ABSTRACT

A method and system for producing a mixed gas-oil stream through a wellbore wherein at least a portion of the gas is separated from the stream downhole and is compressed (e.g. using a SPARC) before both the compressed gas and the remainder of the stream is brought to the surface through separate flowpaths. The system includes a string of tubing which provides the flowpath for the remainder of the stream while the annulus, formed between the tubing string and the wellbore provides the flowpath for the compressed gas.

11 Claims, 2 Drawing Sheets

OIL AND GAS PRODUCTION WITH DOWNHOLE SEPARATION AND COMPRESSION OF GAS

TECHNICAL FIELD

The present invention relates to separating and compressing a portion of the gas from the oil-gas stream produced from a subterranean zone and producing the compressed gas to the surface for processing and/or reinjection and in one aspect relates to a method and downhole system for separating a portion of the gas from a gas-oil stream, compressing the gas, and then producing the compressed gas through the well annulus or by separate flowpath to the surface for processing and/or reinjected into another well.

BACKGROUND

It is well known that many hydrocarbon reservoirs produce extremely large volumes of gas along with crude oil and other liquids. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage or further processing or use. Where the production sites are near or convenient to large markets, this gas is considered a valuable asset when demands for gas are high. However, when demands are low or when the producing reservoir is located in a remote area, large volumes of produced gas can present major problems since production may have to shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which usually overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can be recovered later when the situation dictates.

To reinject the gas, large and expensive separation and compression surface facilities must be built at or near the production site. A major economic consideration in such facilities is the relatively high costs of the gas compressor train which is needed to compress the large volumes of produced gas to the pressures required for injection. As will be understood in this art, significant cost savings can be achieved if the gas compressor requirements can be downsized or eliminated altogether. To achieve this, however, it is necessary to either raise the pressure of the gas at the surface by some means other than mechanical compression or else reduce the pressure required at the surface for injection of the gas downhole.

Various methods and systems have been proposed for reducing some of the separating/handling steps normally required at the surface to process and/or re-inject at least a portion of the produced gas. These methods all basically involve separating at least a portion of the produced gas from the production stream downhole and then handling the separated gas and the remainder of the production stream separately from each other.

For example, one such method involves the positioning of an "auger" separator downhole within a production wellbore for separating a portion of the gas from the production stream as the stream flows upward through the wellbore; see U.S. Pat. No. 5,431,228, issued Jul. 11, 1998. Both the remainder of the production stream and the separated gas are flowed to the surface through separate flowpaths where each is individually handled. While this downhole separation of gas reduces the amount of separation which would otherwise be required at the surface, the gas which is separated downhole still requires basically the same amount of compressor horsepower at the surface to process/reinject the gas as that which would be required if all of the gas in the production stream had been separated at the surface.

Another system involving the downhole separation of gas from a production stream is fully disclosed and claimed in U.S. Pat. 5,794,697, issued Aug. 18, 1998 wherein, a subsurface processing and reinjection compressor (SPARC) is positioned downhole in the wellbore. The SPARC includes an auger separator which first separates at least a portion of the gas from the production stream and then compresses the separated gas by passing it through a compressor which, in turn, is driven by a turbine. The remainder of the production stream is routed through the turbine and acts as the power fluid therefor. The compressed gas is not produced to the surface but instead is injected directly from the compressor into a second formation (e.g. gas cap) adjacent to the wellbore.

Where the separated gas has a use or a market or where there are no formations within the production well for injecting the gas, it is desirable to bring the compressed gas to the surface for further processing or for injection into a separate injection well.

SUMMARY OF THE INVENTION

The present invention provides a method and system for producing a mixed gas-oil stream to the surface from a subterranean zone through a wellbore wherein at least a portion of said gas is separated from said mixed gas-oil stream downhole and is compressed to increase the pressure of the separated gas before flowing both said compressed gas and the remainder of said gas-oil stream to the surface through separate flowpaths in said wellbore. As will be understood in the art, the production stream will normally also include some water which will be produced with the oil and as used herein, "gas-oil stream(s)" is intended to include streams which also may include produced water along with the gas and oil.

The system includes a string of tubing positioned within the wellbore wherein the string of tubing, itself, provides the flowpath through which said remainder of said gas-oil stream flows to the surface while the annulus formed between said string of tubing and said wellbore provides the flowpath through which said compressed gas flows to the surface.

Preferably, the means for separating and compressing at least a portion of the gas downhole is a subsurface processing and reinjection compressor (SPARC) downhole which has an auger separator section for separating the gas, a compressor section for compressing the separated gas, and a turbine section for driving the compressor section. The compressed gas is produced to the surface where it may be further processed for sale or use (e.g. additional condensate can be removed from the gas) or it can be reinjected into a separate wellbore for disposal or the like. In some instances, the compressed gas from a plurality of wellbores may be compounded together before the gas is reinjection into a separate wellbore(s).

By separating and compressing at least a portion of the produced gas and then bringing the compressed gas to the surface, several advantages may be realized over the use of a auger separator or a SPARC by themselves. First, the separated gas, which is compressed downhole by the SPARC, does not have to be reinjected directly into a formation which lies adjacent the same wellbore as that from which the stream is produced as is the typically operating procedure proposed in known, prior-art SPARC operations. By bringing the compressed gas to the surface, the compressed gas can now be re-injected into a separate disposal well(s). Further, the compressed gas, once at the surface, is now available of use on site (e.g. fuel, to drive power turbines, etc.) or it be further compressed, if necessary, and pipelined to market. In either event, the compressor horsepower, normally required at the surface, can be significantly reduced.

Also, by bringing the separated gas, which is warmed as it is compressed, to the surface through the well annulus, it flows in parallel to the remainder of the gas-oil stream in the tubing string which, in turn, has been cooled as it expands through the turbine section of the SPARC. In prior SPARC applications, this cooled stream can have a tendency to form undesirable hydrates, etc. as it flows up through the tubing string. The two parallel flowpaths of the present invention function as a heat exchanger between the respective streams thereby moderating the temperatures of both streams. Still further, condensate can be removed from the compressed gas using typical surface equipment before the gas is used, marketed, or re-injected into a wellbore while, in other embodiments, the compressed gas from several production wells can be combined or manifolded through a common line before the compressed gas is further processed and/or re-injected.

BRIEF DESCRIPTION OF THE DRAWINGS

The actual construction, operation, and apparent advantages of the present invention will be better understood by referring to the drawings which is not necessarily to scale and in which like numerals refer to like parts and in which.

BEST KNOW MODE FOR CARRYING OUT THE INVENTION

Figure 1:
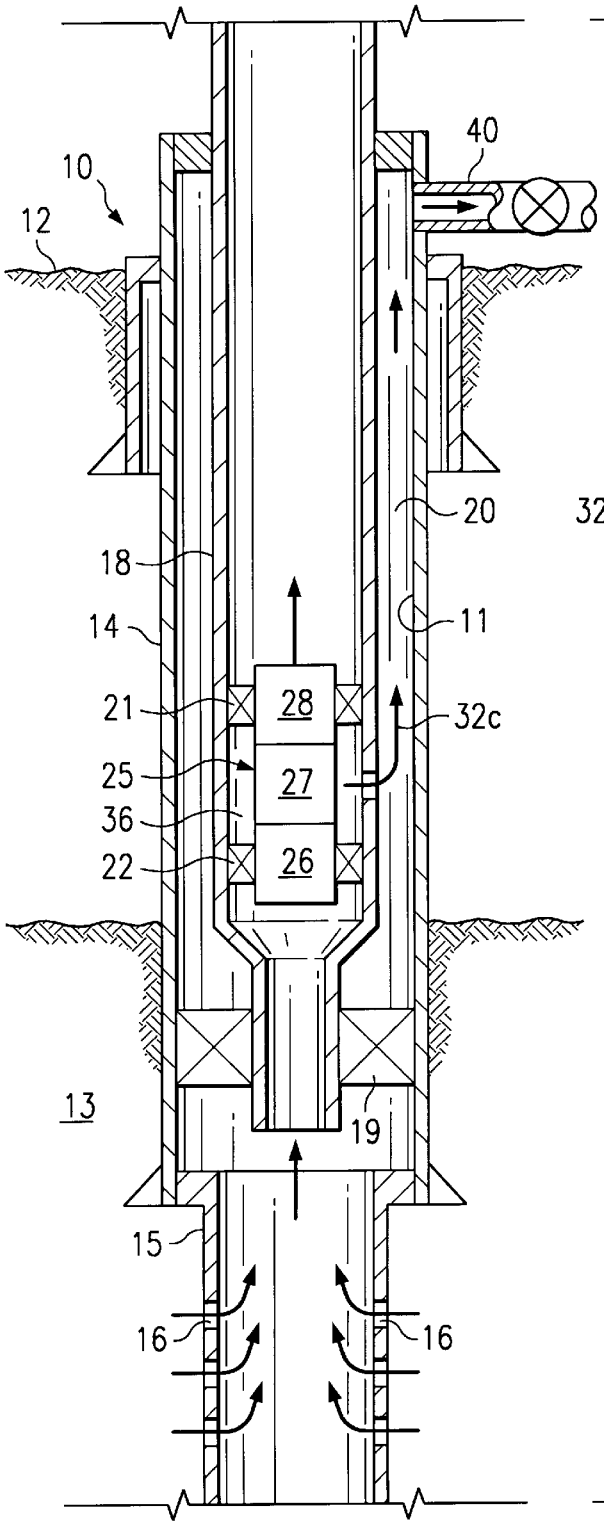
FIG. 1 schematically illustrates a well completed in accordance with the downhole system of the present invention.

Referring more particularly to the drawings, FIG. 1 discloses a production well 10 having a wellbore 11 which extends from the surface 12 into and/or through a production zone 13. As illustrated in FIG. 1, wellbore 11 is cased with a string of casing 14 to a point slightly above zone 13. A liner 15 or the like is suspended from the lower end of casing 14 and has a plurality of openings 16 adjacent production zone 13 to allow flow of fluids from zone 13 into the wellbore. While this is one well-known way to complete a well, it will be recognized that other equally as well-known techniques can be used without departing from the present invention: e.g., wellbore 11 may be cased throughout it entire length and then perforated adjacent zone 13 or it may be completed "open-hole" adjacent zone 13, etc.

A string of tubing 18 is positioned within casing 14 and extends from the surface substantially throughout the length of casing 14 and into or just above the top of liner 15. As illustrated, the diameter or the lower end of tubing 18 (i.e. "tubing tail") may be reduced and is adapted to carry packer 19, which when set, blocks flow through annulus 20 which, in turn, is formed between tubing 18 and casing 14. A subsurface processing and reinjection compressor (SPARC) 25 is positioned within tubing 18 above the tubing tail or lower end thereof. SPARC 25 is basically comprised of three sections; auger separator section 26, compressor section 27, and turbine section 28. Packers 21, 22 are spaced on SPARC 25 for a purpose described below.

Figure 2:
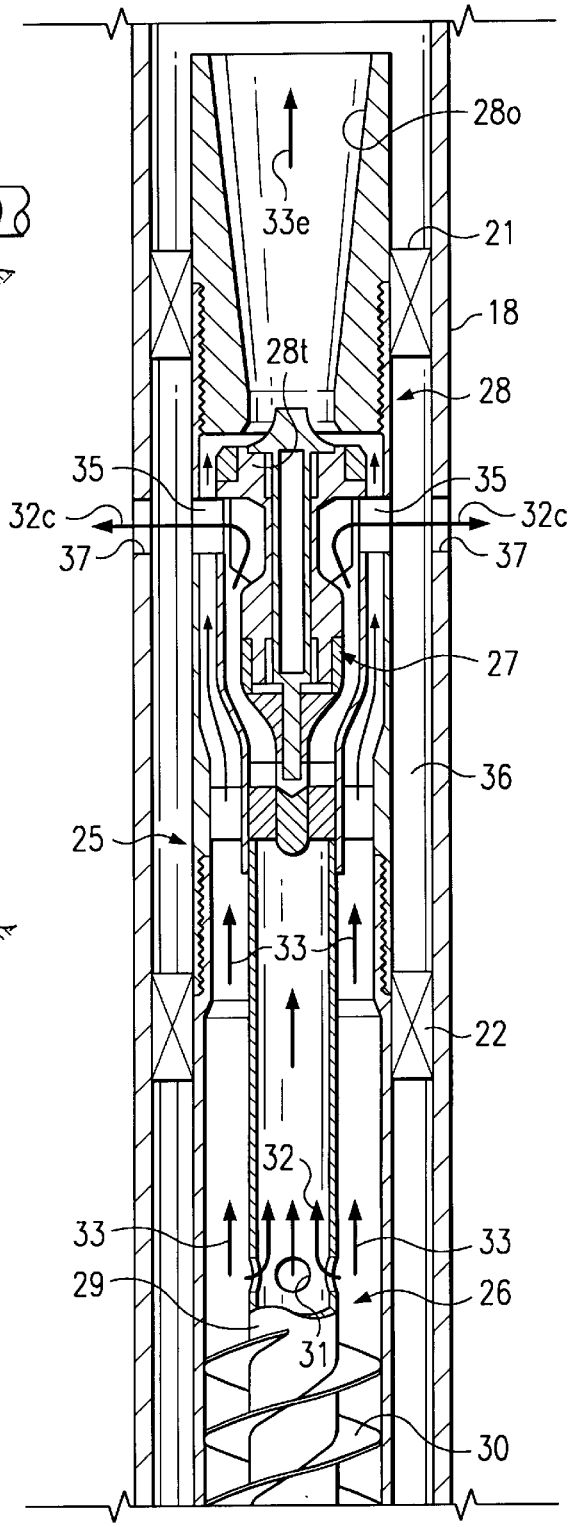
FIG. 2 is an enlarged, cross-sectional view of the downhole separator-compressor of the downhole system illustrated in FIG. 1.

Referring now to FIG. 2, auger separator section 26 is comprised basically of a central tube 29 which has an auger-like blade 30 thereon (only a portion of which is shown). Auger separator 26 separates at least a portion of the gas from a mixed liquid-gas production stream as it flows from zone 13 and follows the spiral flowpath defined by auger blade 30. The liquid (e.g. oil and possibly water) in the stream is forced to the outside of the blade by centrifugal force while at least a portion of the gas is separated from the stream and remains near the wall of the center tube. As the stream reaches the end of blade 30, the separated gas (arrows 32 in FIG. 2) will flow through an inlet port 31 in the tube while the liquid and remaining gas will continue to flow along the outside of tube (arrows 33 in FIG. 2).

Auger separators of this type are known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex.

The separated gas 32 now flows up through the inside of central tube 29 and into the inlet of compressor section 27 where it is compressed before it exits through outlet 35 as compressed gas **32*c* into the isolated section 36 of tubing 18 which is defined by packers 21, 22. The compressed gas 32*c* from isolated section 36 flows through opening(s) 37 in tubing 18 and into well annulus 20 (FIG. 1). The compressed gas 32*c* flows upward to the surface through annulus 20 and into line 40** for transport to market, use at the well site, or for re-injection into a well as will be explained in detail below.

The remaining stream of oil and any unseparated gas (arrows 33) continues to flow upward from separator 26, through by-passes around compressor outlet 35 (not numbered for clarity) and into the inlet of turbine section 28. The remaining stream 33 is under high pressure which will drive the turbine **28*t* as it expands therethrough into turbine outlet 28*o*. The turbine 28*t*, in turn, drives compressor 27** as well understood in the art. The SPARC, as described above, is well known and is fully disclosed and discussed in U.S. Pat. No. 5,794,697, issued Aug. 18, 1998.

It will be recognized that the remaining oil-gas stream **33*e* will cool significantly as it expands through turbine 28*t*. In other SPARC applications, this cooled stream 33*e* can have a tendency to form hydrates, etc. as it flows up tubing 18 which, in turn, can have adverse effects on overall production. In the present invention, the separated gas 32***c*, which is warmed as it is compressed, flows through annulus 20 in parallel to the flow of the cold expanded stream 33*e* in tubing 18. The two parallel flowpaths function as a heat exchanger between the respective streams flowing therethrough thereby maintaining the temperatures of both streams at acceptable levels.

By separating and compressing at least a portion of the produced gas before the compressed gas is brought to the surface, several advantages are realized over the use of a auger separator, per se, or other the prior uses of a SPARC. First, the compressed gas does not have to be injected into a formation lying adjacent the same wellbore (i.e. the production wellbore) as was typically proposed in prior SPARC operations but, instead can be re-injected from the surface into other disposal wells. Further, the compressed gas can merely be used on site (e.g. fuel, to drive power turbines, etc.) or it be further compressed, if necessary, and pipelined to market. In either event, the compressor horsepower at the surface can be significantly reduced.

Figure 3:
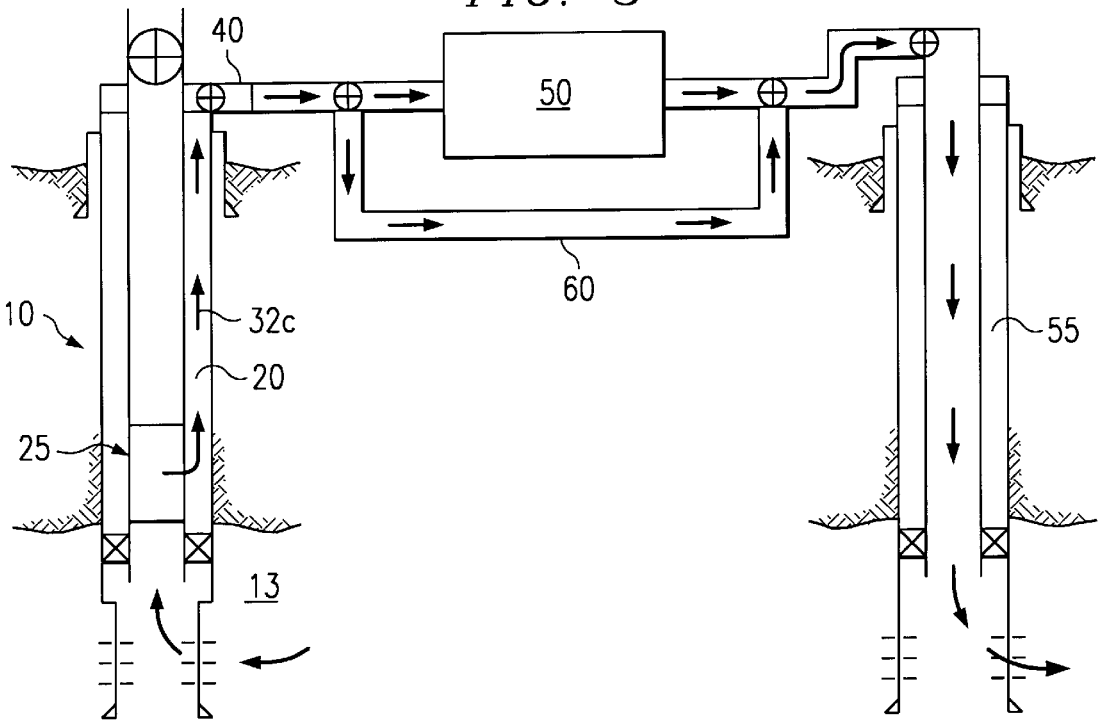
FIG. 3 is a schematical illustration of the gas separated downhole in a production well being processed at the surface before being reinjected into a spaced, injection well.
Figure 4:
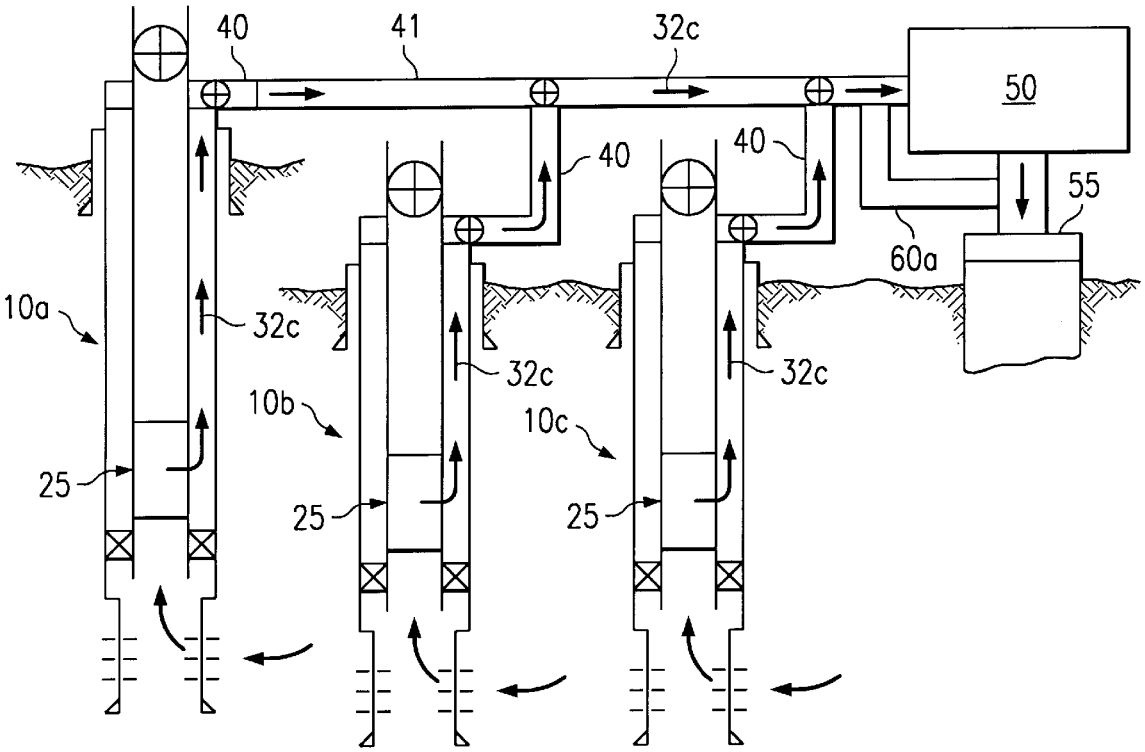
FIG. 4 is a schematical illustration of a plurality of production wells manifolded together to allow the common processing of the downhole separated gas from each of the wells.

Also, in some instances, condensate can be removed from at least a portion of the compressed gas stream 32*c* with typical surface equipment 50 (e.g. scrubbers, turbo expanders absorbers, etc.; FIG. 3) before the gas is re-injected into injection well 55 or can by-pass equipment 50 through line 60 and be injected directly into well 55. Still further, the compressed gas from several production wells (e.g. wells 10*a*, 10*b*, 10*c*, FIG. 4) can be manifolded through a common line 41 into surface processing equipment 50 (e.g. scrubbers, etc.) before re-injection into an injection well 55 or it may by-pass the processing equipment 50 through line 60*a* and be injected directly into the well.

What is claimed is:

1. A method for producing a mixed gas-oil stream to the surface from a subterranean zone through a wellbore; said method comprising:

separating at least a portion of said gas from said mixed gas-oil stream downhole as said mixed streams flows upward through said wellbore;

compressing said portion of the separated gas downhole to increase the pressure thereof; and flowing both said compressed gas and the remainder of said gas-oil stream to the surface through separate flowpaths in said wellbore.

2. The method of claim 1 wherein said wellbore includes a string of tubing therein and wherein said separate flowpaths comprise:

said string of tubing through which said remainder of said gas-oil stream flows; and an annulus formed between said string of tubing and said wellbore through which said compressed gas flows.

3. The method of claim 2 including:

positioning a subsurface processing and reinjection compressor (SPARC) downhole for separating and compressing said at least a portion of said gas from said gas-oil stream.

4. The method of claim 1 wherein said compressed gas is processed at the surface for sale.

5. The method of claim 1 including:

reinjecting said compressed gas from said surface into a separate wellbore for disposal.

6. A method of claim 1 wherein the compressed gas from a plurality of wellbores is compounded together for reinjection into a separate wellbore.

7. A system for producing a mixed gas-oil stream from a subterranean zone to the surface through a wellbore said system comprising:

a string of tubing positioned within said wellbore and extending to said surface zone wherein an annulus is formed between said tubing and said wellbore;

a separator positioned downhole within said tubing and adapted to separate at least a portion of said gas from said gas-oil stream as said stream flows upward through said tubing;

a compressor positioned downhole within said tubing and adapted to receive said separated gas from said separator and adapted to compress said separated gas; and means for fluidly communicating said compressor with said annulus whereby compressed gas flowing from said compressor will flow to the surface through said annulus.

8. The system of claim 7 including:

equipment on the surface adapted to receive said compressed gas from said annulus for further processing of said compressed gas.

9. The system of claim 7 including:

means for combining said compressed gas from said well with compressed gas from other wells; and means for reinjecting said combined compressed gas into a separate wellbore.

10. The system of claim 7 wherein said separator is an auger separator.

11. The system of claim 10 wherein said compressor comprises:

a compressor section adapted to receive the separated gas from said auger separator; and a turbine section adapted to receive the remainder of said gas-oil stream, said remainder of said gas-oil stream adapted to expand through said turbine to thereby drive said compressor section.

* * * * *